US006449922B2

(12) United States Patent
Lancaster, III et al.

(10) Patent No.: US 6,449,922 B2
(45) **Date of Patent: *Sep. 17, 2002**

(54) METHOD AND APPARATUS FOR STRETCH WRAPPING A LOAD

(75) Inventors: Patrick R. Lancaster, III, Louisville, KY (US); Curtis Martin, Floyds Knobs, IN (US)

(73) Assignees: Lantech Management Corp., Louisville, KY (US); Lantech Holding Corp., Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/768,338

(22) Filed: Jan. 25, 2001

Related U.S. Application Data

(63) Continuation of application No. 09/137,119, filed on Aug. 20, 1998, now Pat. No. 6,269,610.

(51) Int. Cl.[7] ..... B65B 11/04

(52) U.S. Cl. ..... 53/399; 53/441; 53/587; 53/556

(58) Field of Search ..... 53/399, 441, 556, 53/587, 588, 211

(56) References Cited

U.S. PATENT DOCUMENTS

| | | | | |
|---|---|---|---|---|
| 4,077,179 A | * | 3/1978 | Lancaster et al. | 53/441 |
| 4,216,640 A | | 8/1980 | Kaufman | |
| 4,300,326 A | | 11/1981 | Stackhouse | |
| 4,432,185 A | | 2/1984 | Geisinger | |
| 4,563,863 A | | 1/1986 | Humphrey | |
| 4,619,102 A | | 10/1986 | Geisinger | |
| 4,765,120 A | | 8/1988 | Phillips | |
| 4,845,920 A | | 7/1989 | Lancaster | |
| 4,972,656 A | | 11/1990 | Haugstad | |
| 4,995,224 A | | 2/1991 | Yourgalite et al. | |
| 5,005,335 A | | 4/1991 | Yourgalite et al. | |
| 5,168,691 A | | 12/1992 | Errani | |
| 5,408,808 A | * | 4/1995 | Masuda et al. | 53/556 |
| 5,564,258 A | | 10/1996 | Jones, Sr. et al. | |
| 5,765,344 A | | 6/1998 | Mandeville et al. | |
| 5,941,049 A | | 8/1999 | Lancaster et al. | |
| 6,164,047 A | | 12/2000 | Rossi | |
| 6,185,900 B1 | * | 2/2001 | Martin et al. | 53/399 |
| 6,189,291 B1 | * | 2/2001 | Martin et al. | 53/399 |
| 6,269,610 B1 | * | 8/2001 | Lancaster, III et al. | 53/399 |

FOREIGN PATENT DOCUMENTS

| | | |
|---|---|---|
| EP | 0 430 902 | 6/1991 |
| EP | 0 517 502 | 12/1992 |
| EP | 0 671 324 | 9/1995 |
| GB | 2014107 | 8/1979 |
| GB | 2216489 | 10/1989 |

* cited by examiner

*Primary Examiner*—Stephen F. Gerrity
(74) *Attorney, Agent, or Firm*—Finnegan, Henderson, Farabow, Garrett & Dunner, L.L.P.

(57) ABSTRACT

A leading end of packaging material is grasped in a packaging material holder while a load is wrapped. Packaging material is dispensed from a packaging material dispenser, and relative rotation is provided between the dispenser and a load to wrap packaging material around the load. The packaging material holder may be positioned on the rotating surface of a turntable but isolated from any electrical or fluid power source of a rotatable surface of the turntable. During the wrapping cycle, the packaging material holder moves downstream along the turntable, automatically releasing the leading end of the packaging material and automatically grasping a trailing end of the packaging material. The packaging material is weakened and then severed between the packaging material holder and the load. The packaging material holder is mounted to permit it to move upstream due to force exerted by the packaging material held in the holder.

17 Claims, 14 Drawing Sheets

METHOD AND APPARATUS FOR STRETCH WRAPPING A LOAD

This is a continuation of application Ser. No.09/137,119, filed Aug. 20,1998 now U.S Pat. No. 6,269,610 which is incorporated herein by reference.

BACKGROUND OF THE INVENTION

The present invention relates to a method and apparatus for wrapping a load with packaging material.

Loads have been stretch wrapped with stretch wrap packaging material by securing a leading end of the packaging material to the load or a turntable clamp, dispensing the packaging material by providing relative rotation between the load and a packaging material dispenser to cause the load to be enveloped by the packaging material, and severing the packaging material between the load and a packaging material dispenser. The relative rotation between the load and the dispenser can be provided either by rotating the load on a turntable, or by rotating the dispenser around a stationary load. Stretch wrapping usually employs a web of stretch film as the packaging material, and the machinery can be either automatic or semi-automatic.

Semi-automatic stretch wrapping machinery requires the operator to attach a leading end of the packaging material to the load for each load to be wrapped. This is typically accomplished by forming a rope in the leading end of the film and then inserting this end between the layers of the load or by tying the end of the packaging material to the edge of the supporting wood pallet or any suitable outcropping on the load. This attachment must be relatively strong since it provides the reaction to force needed to pull the film from the film dispenser during the initiation of the relative rotation between the load and the film dispenser. The attachment or tying of the film makes film removal more difficult after the load has been shipped to its destination.

Automatic stretch wrapping machines are significantly more expensive than semi-automatic machines. The automatic machines typically use film clamps that grip the film web between two opposed surfaces, use electrical or pneumatic actuators to open and close the clamps, typically supply electrical or pneumatic power to the actuators on a turntable through the journal of the turntable, and use hot wires or other expensive cutting devices to cut the film. Such film clamps create a "tenting" effect during wrapping due to the distance between the clamp and the load during wrapping, resulting in wasted film and loosely wrapped loads.

In light of the cost of such automatic machines, there is a need for a method and apparatus for wrapping a load with packaging material that operates as effectively as those previously developed to allow automatic release and clamping of portions of the packaging material but which can be manufactured at a lower cost.

SUMMARY OF THE INVENTION

Accordingly, the present invention is directed to a method and apparatus for wrapping a load with packaging material which provides advantages over and obviates several problems associated with earlier methods and apparatus for wrapping a load.

To achieve these and other advantages and in accordance with the purpose of the invention, as embodied and broadly described, the invention concerns an apparatus for wrapping a load with packaging material, including a dispenser for dispensing packaging material, a rotatable turntable for providing relative rotation between the dispenser and the load to wrap packaging material around the load, and a packaging material holder mounted on the turntable and isolated from any electrical or fluid power source by the rotatable turntable for automatically grasping and releasing portions of the packaging material.

According to another aspect of the present invention, the invention concerns an apparatus for wrapping a load with packaging material, including a dispenser for dispensing packaging material, means for providing relative rotation between the dispenser and the load to wrap packaging material around the load, and a packaging material holder for holding and releasing the packaging material, the packaging material holder being mounted to move upstream with the packaging material in response to force exerted on the packaging material by the packaging material holder to permit the packaging material to sever at a weakened portion between the packaging material holder and the load.

According to a further aspect of the present invention, there is provided a method of wrapping a load with packaging material, including grasping a leading end of packaging material with a packaging material holder mounted on a rotatable turntable and isolated from any electrical or fluid power source by the rotatable turntable, dispensing packaging material from a packaging material dispenser and rotating the turntable to wrap packaging material around the sides of the load, automatically releasing the leading end of the packaging material from the packaging material holder, and automatically grasping a trailing end of the packaging material with the packaging material holder at a point upstream of the leading end.

According to another aspect of the present invention, a method of wrapping a load with packaging material is provided including dispensing packaging material from a packaging material dispenser and providing relative rotation between the dispenser and the load to wrap packaging material around the sides of the load, holding a portion of the packaging material in a packaging material holder, weakening the packaging material between the load and the packaging material dispenser, and severing the packaging material at the weakened portion by tensioning the packaging material between the packaging material dispenser and the load while permitting the packaging material holder to move upstream with the packaging material toward the dispenser.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of the specification, illustrate an embodiment of the invention, and together with the description serve to explain the principles of the invention.

DETAILED DESCRIPTION OF THE PREFERRED EMBODIMENTS

Figure 1A:
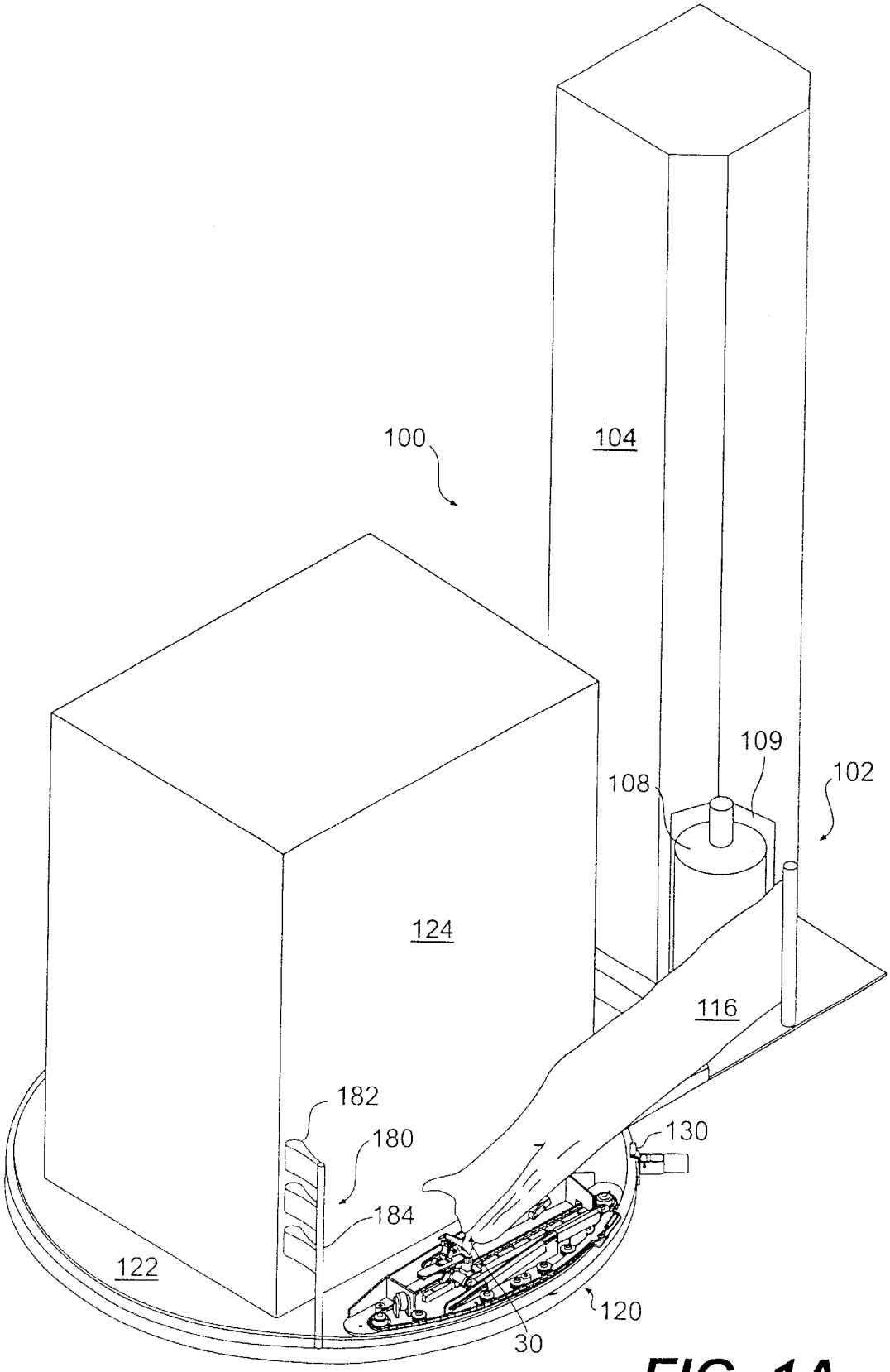
FIG. 1A is a perspective view of the load wrapping apparatus of the present invention.

The following text and accompanying drawings illustrate examples of the present preferred embodiments of the present invention.

According to the invention, an apparatus is provided for wrapping a load with packaging material. As embodied herein and shown in FIGS. 1A and 1B, an apparatus for wrapping a load with packaging material is generally designated by the reference numeral 100 and includes a packaging material dispenser, means for providing relative rotation between a load and the dispenser, and a packaging material holder.

Figure 1B:
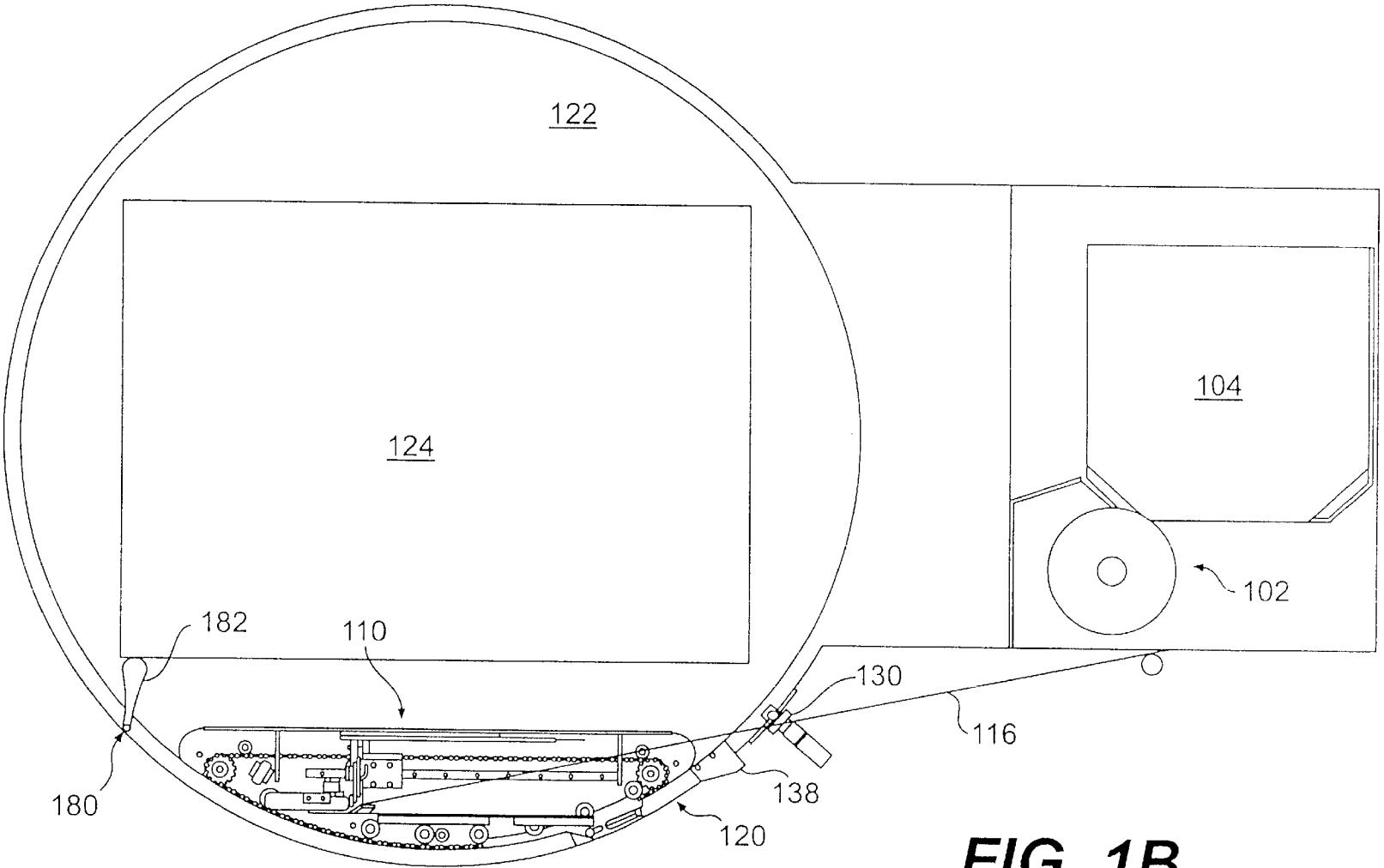
FIG. 1B is a top view of the load wrapping apparatus of FIG. 1A.

As shown in FIG. 1A and FIG. 1B a dispenser 102 is provided for dispensing packaging material. Packaging material dispenser 102 dispenses a sheet of packaging material 116 in a web form. Packaging material dispenser 102 includes a roll carriage 109 that supports a roll of packaging material 108. Roil carriage 109 of dispenser 102 is mounted on and vertically moveable on a mast 104, shown in FIGS. 1A and 1B to dispense packaging material 116 spirally about load 124 as rotation is provided between load 124 and dispenser 102. Roll carriage 109, as embodied herein and shown in FIGS. 1A and 1B includes a support for packaging material roll 108 and means for moving on mast 104. Alternatively, roll carriage 109 may include a container for holding packaging material roll 108, and a slit for dispensing packaging material 116 from packaging material roll 108.

In a preferred embodiment, stretch wrap packaging material is used. In the stretch wrapping art, stretch wrap packaging material is known to have a high yield coefficient to allow the material a large amount of stretch during wrapping. Various other packaging materials, generally not considered to be stretch wrap materials, such as netting, strapping, banding, and tape, can be used as well. Dispenser 102 may also include a variety of rollers, optionally including prestretch rollers for stretching the packaging material longitudinally and/or transversely, to position, dispense, and stretch the packaging material as packaging material 116 is being dispensed from the roll of packaging material.

Figure 2:
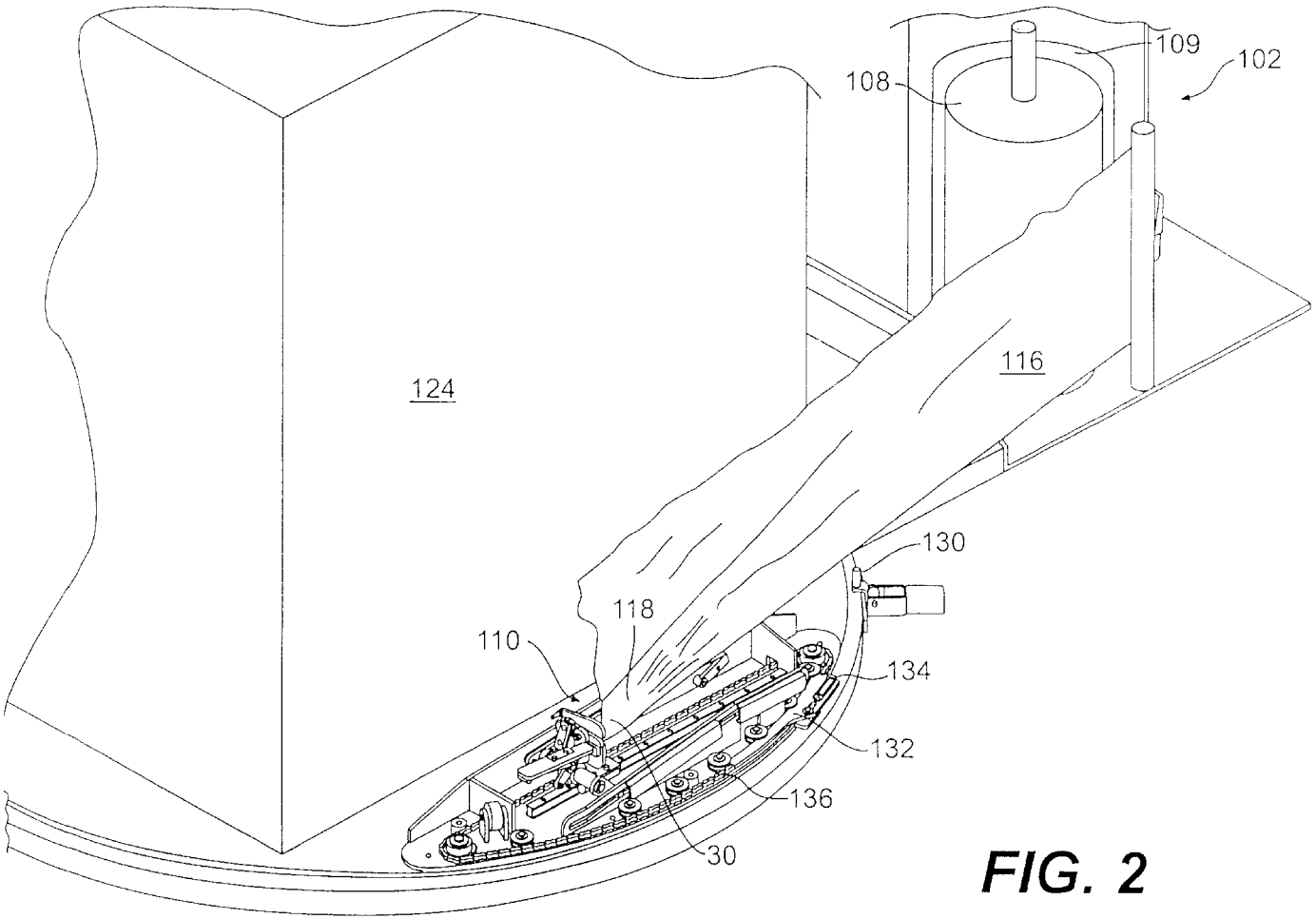
FIG. 2 is an enlarged fragmentary perspective view of apparatus shown in FIG. 1.

As shown in FIGS. 1A, 1B and 2, apparatus 100 includes means for providing relative rotation between the dispenser and the load to wrap packaging material around the load. As embodied herein, the means for providing relative rotation include a conventional turntable assembly 120. Turntable assembly 120 has a rotatable turntable load 124 to be wrapped from a load building area. Load 124 is rotated by rotatable turntable 122 of turntable assembly 120 to provide relative motion between dispenser 102 and load 124.

Although not shown here, turntable assembly 120 may include an upper conveying surface with a plurality of powered rollers. As an alternative to the turntable embodiment, relative rotation may be accomplished by rotating dispenser 102 around a stationary load.

According to the present invention, a packaging material holder for automatically releasing and grasping portions of the packaging material is provided. As embodied herein and shown in FIGS. 1A–4B, the packaging material holder includes packaging material holder 110, mounted on rotatable turntable 122 of turntable assembly 120. Packaging material holder 110 includes a clamp for grasping, holding, and releasing packaging material 116, and a mechanical movement for actuating the clamp. A roper for forming a rope of the packaging material, and a packaging material weakener for weakening the packaging material prior to severing are provided as well in this embodiment.

The clamp for holding and releasing packaging material 116, as shown in FIGS. 1A–4B, preferably includes opposed surfaces for grasping the packaging material 116, such as jaws 112, 114. Jaws 112, 114 may be made of any suitable material, such as metal or plastic, and in any suitable shape which will allow the jaws to grasp and hold the packaging material without severing it. Jaws 112,114 are preferably mounted on a rail mounted on the turntable to allow jaws 112, 114 to translate relative to the turntable. Other alternative embodiments of the packaging material holder may include other arrangements such as a single unopposed packaging material engaging surface, such as a sticky or tacky surface for holding the packaging material, or in some instances, a vacuum surface.

As shown in FIGS. 3A, 3B and 4A, 4B the mechanical movement is mounted on the rotatable turntable and includes a floating cam in the form of a ramp 150 attached to rotatable turntable 122 for supporting the packaging material holder 110 on the turntable assembly 120. The upper surface of ramp 150 forms a downstream pathway 152 at a first height, and the lower surface of ramp 150 forms an upstream pathway 154 at a second, lower height. "Upstream" and "downstream," as used herein, are intended to define the direction of movement relative to the flow of packaging material from the dispenser 102. Thus, since the packaging material flows from the dispenser, movement toward the dispenser and against the flow of packaging material from the dispenser is defined as "upstream" and movement away from the dispenser and with the flow of packaging material from the dispenser is defined as "downstream." As used herein, the leading end 30 of packaging material 116 is downstream of the trailing end 32 of packaging material 116.

Figure 5:
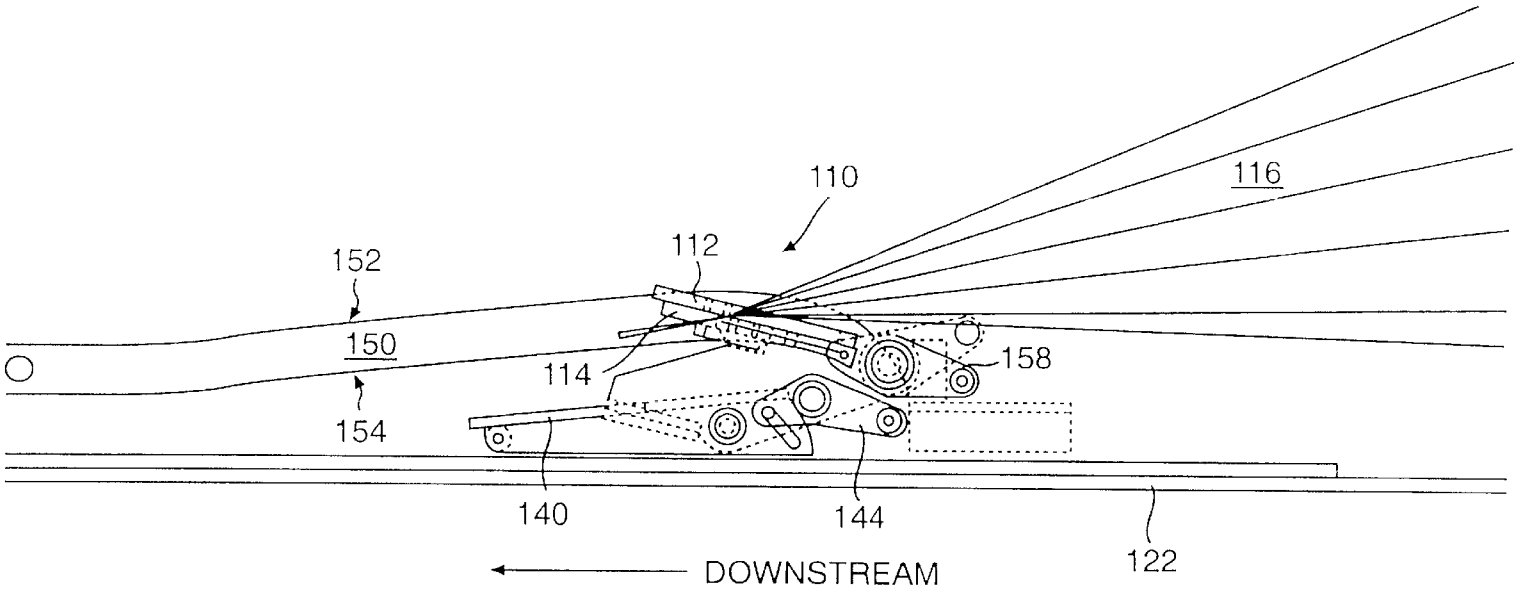
FIGS. 5–11 are schematics showing movement of the packaging material holder during the wrapping process of the present invention.

As embodied herein, the mechanical movement also includes a cam follower 158, which allows jaws 112, 114 to travel on the paths 152, 154 of ramp 150. As shown in FIG. 5, the cam follower 158 sits at an upstream end of ramp 150 when holding the packaging material during wrapping. Upon actuation of packaging material holder 110, cam follower 158 moves to the top of the upstream end of ramp 150 and then travels along downstream path 152. Movement of cam follower 158 up onto the upper surface of ramp 150 automatically causes jaws 112, 114 of packaging material holder 110 to open. Jaws 112, 114 remain open as long as cam follower 158 is moving along the downstream path 152 of ramp 150. Once cam follower 158 reaches the end of downstream path 152 of ramp 150, cam follower 158 rolls off of the end of ramp 150. Cam follower 158 rolling off the end of ramp 150 automatically causes jaws 112, 114 to close. As used herein, the term "automatically" is intended to mean that manual assistance is normally not required.

As embodied herein, the mechanical movement includes a cog mechanism 132 that rotates with packaging material holder 110 as turntable 122 rotates. Cog mechanism 132 consists of an engaging element 134 and a chain element 136. Chain element 136 forms a complete loop, connected at each of its ends to engaging element 134. Chain element 136 engages gears placed along the length of packaging material holder 110, and is moveable along the length of packaging material holder 110.

As embodied herein, an actuator for the mechanical movement is provided. Preferably, the actuator is positioned apart from rotatable turntable 122 and the mechanical movement, so that the actuator does not rotate with rotatable turntable 122. As shown, the actuator includes a pin 130. Engaging element 134 engages and is driven by pin 130 attached to the non-rotating portion of turntable assembly 120. Pin 130 is moveable between a non-upright position and an upright position, and pin 130 may be actuated to move to the upright position by a controller. In the upright position, pin 130 engages engaging element 134 of cog 132 as cog 132 rotates with rotatable turntable 122, driving cog 132 in a direction opposite to that of the rotation, As cog 132 is driven along the length of ramp 150 of packaging material holder 110, jaws 112, 114 of packaging material holder 110 move along the length of ramp 150 in the opposite direction, driven along the downstream path 152.

Cog element 132 also includes a release element 138 attached to rotatable surface 122 of turntable 120. Release element 138 is positioned at the upstream end of packaging material holder 110. Release element 138 is positioned to knock down or disengage pin 130 from cog 132 once cog 132 has moved from the downstream end of packaging material holder 110 to the upstream end of packaging material holder 110. As the length of packaging material holder 110 defines the full range of movement for cog 132, it is necessary to have a release once cog 132 has reached the end of its range of motion. Release element 138 serves this purpose.

Jaws 112, 114 of packaging material holder 110 move along upstream path 154 after it has reached the end of downstream path 152. Cam follower 158 is pulled along upstream path 154 by the force exerted upon packaging material 116 held in jaws 112, 114 by the roll of packaging material in dispenser 102. As shown in FIGS. 3A, 3B and 4A, 4B, downstream path 152 is positioned above upstream path 154, such that packaging material holder 110 travels at a first level downstream, and at a second, lower level upstream.

As discussed above, packaging material holder 110 is mounted on the top surface of rotatable turntable 122, and jaws 112, 114 of packaging material holder 110 are actuated to automatically open and close at predetermined points along the length of ramp 150 of packaging material holder 110. As embodied herein, packaging material holder 110 is isolated from any electrical or fluid source of power by the turntable, in contrast to conventional devices in which the packaging material holder is connected to an electrical or fluid source of power by the turntable such as by a power connection through the journal of the turntable to the packaging material holder. This means that the packaging material holder also does not receive any electrical or fluid power from brushes, or the like, around a circumference of the turntable. The rotatable turntable 122 therefore does not carry electrical or fluid power sources with it during rotation and acts as a barrier between the packaging material holder and any electrical or fluid source of power.

This enables the present invention to take advantage of the changing of the angle of the packaging material relative to the load as the turntable rotates. The rotation of the turntable is harnessed to linearly move the packaging material holder along the turntable surface. During the last rotation of the turntable, as the angle becomes smaller and the packaging material approaches the side of the load, the packaging material holder is driven by the rotation of the turntable into a position to engage the trailing end of the packaging material.

In a preferred embodiment, as shown in FIG. 2, the movement of the turntable is utilized to move jaws 112, 114, opening and closing jaws 112, 114 to automatically release and grasp, respectively, packaging material 116. As discussed above, cog element 132 cooperates with pin 130 to move jaws 112, 114 relative to rotatable turntable 122 and thereby open and close jaws 112, 114. Pin 130 can be actuated to move from the non-upright position to the upright position at a predetermined point in the wrapping cycle by the controller. Preferably, pin 130 is actuated during the last rotation in the wrapping cycle, and most preferably during the last quarter turn of the wrapping cycle, to engage cog 132. Because cog 132 moves with rotatable surface 122 of turntable 120, the rotation of the turntable can be used to move cog 132. Cog 132 is moveably connected to jaws 112, 114 such that, if cog 132 moves to the left, jaws 112, 114 will move to the right. Alternatively, if cog 132 is moved to the right, jaws 112, 114 will move to the left. Thus, it is the rotation of the turntable, rather than an electrical or fluid power source carried by the rotating turntable, that is used to move and thereby automatically open and close jaws 112, 114.

Other mechanical movements including various combinations of mechanical or electrical devices may be used to cause movement and opening and closing of jaws 112, 114. Alternatively, turntable 122 may not rotate while the packaging material is automatically released and grasped by the packaging material holder. In such a situation, packaging material holder 110 could be powered by a separate power source such as a motor placed on the floor or near the turntable.

According to one aspect of the invention, a roper may be provided for forming a rope of packaging material. As discussed herein, "roping" packaging material means rolling or twisting or collapsing a portion of the web of packaging material 116 to shape it into a rope-like form. In order to withstand a starting force during wrapping, at least 20% of the web of packaging material 116 should be held by the packaging material holder. For example, a web of packaging material twenty (20) inches high may have a five (5) or six (6) inch portion formed into a rope. This allows the jaws 112, 114 to engage a rope 118 and a portion of the web of packaging material 116, rather than holding only a small portion of the packaging material 116 between the opposing surfaces. As seen in FIGS. 1A, 1B and 2, jaws 112, 114 can grasp a substantial cross section of the web of packaging material 116 when it has been roped. This gives the lower portion of the web of packaging material 116 between jaws 112, 114 and dispenser 102 the triangular shape seen in FIGS. 1A, 1B and 2. As embodied herein and shown in FIGS. 4A, 4B, the roper includes scooping element 140, which is attached to and moveable with jaws 112, 114 of packaging material holder 110. As jaws 112, 114 and scooping element 140 move along downstream path 152, they move from a flat position to an upright position. As scooping element 140 changes position, it captures the web of packaging material 116 and rolls the packaging material 116 into a rope 118 as it moves into the full upright position.

Although the present invention, as embodied herein, uses a scoop for roping, it is possible to use a wheel to roll the lower edge of the packaging material upward to form a rope of packaging material or to use a combination of a scoop and a wheel. Alternatively, other means such as a ramp may be used to gather the packaging material together to form a rope.

A positioner may be provided for passing the packaging material over the packaging material holder during wrapping. As embodied herein and shown in FIGS. 3A, 3B and 4A, 4B the positioner for passing the packaging material over packaging material holder includes wheel 141. Wheel 141 rolls a lower edge of packaging material 116 as it passes over wheel 141, lifting it above packaging material holder 110. Thus it causes packaging material 116 to pass above packaging material holder 110, avoiding the tenting effect of holders in the prior art.

Figure 3A:
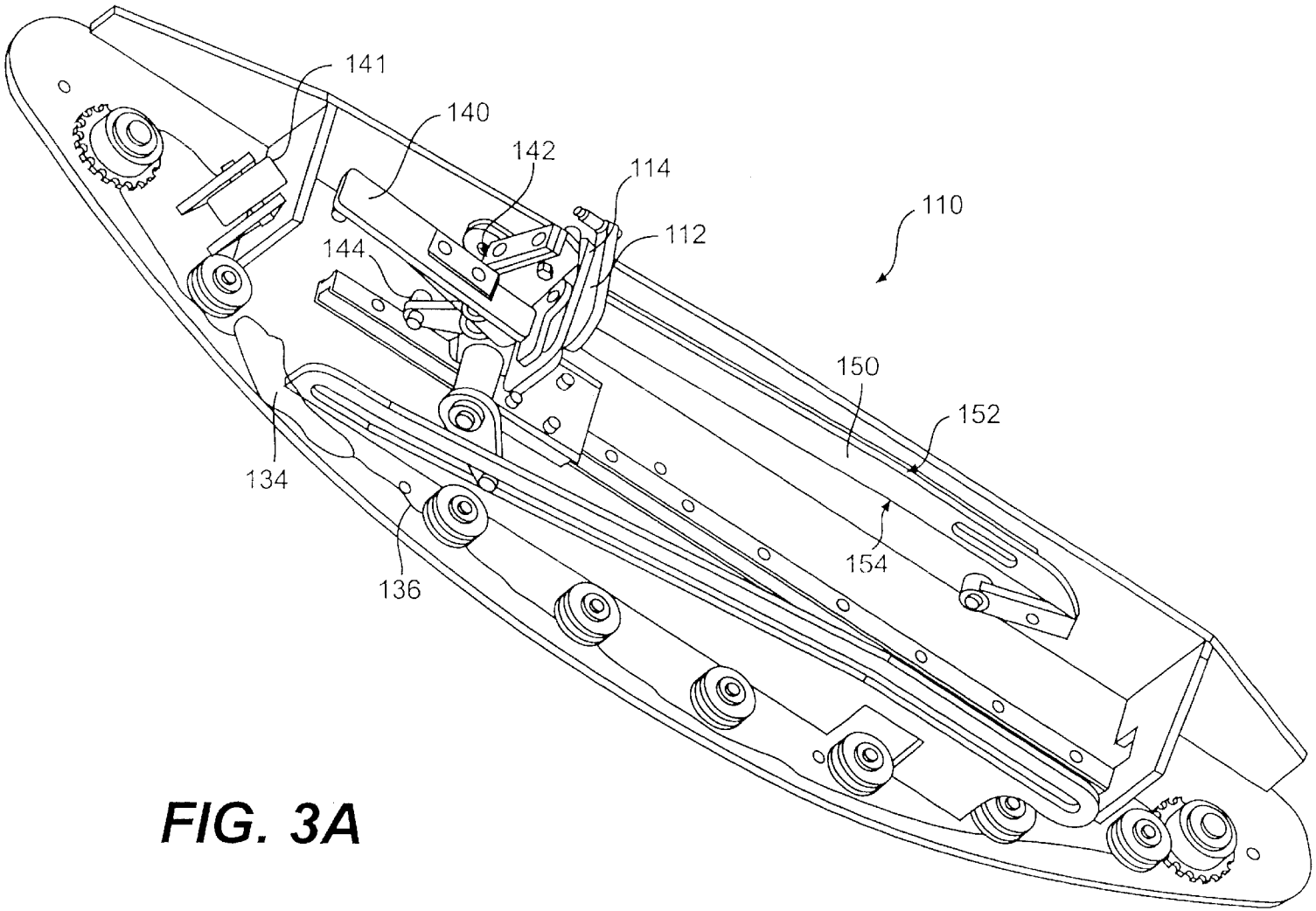
FIG. 3A is a perspective view of the packaging material holder of the present invention.
Figure 3B:
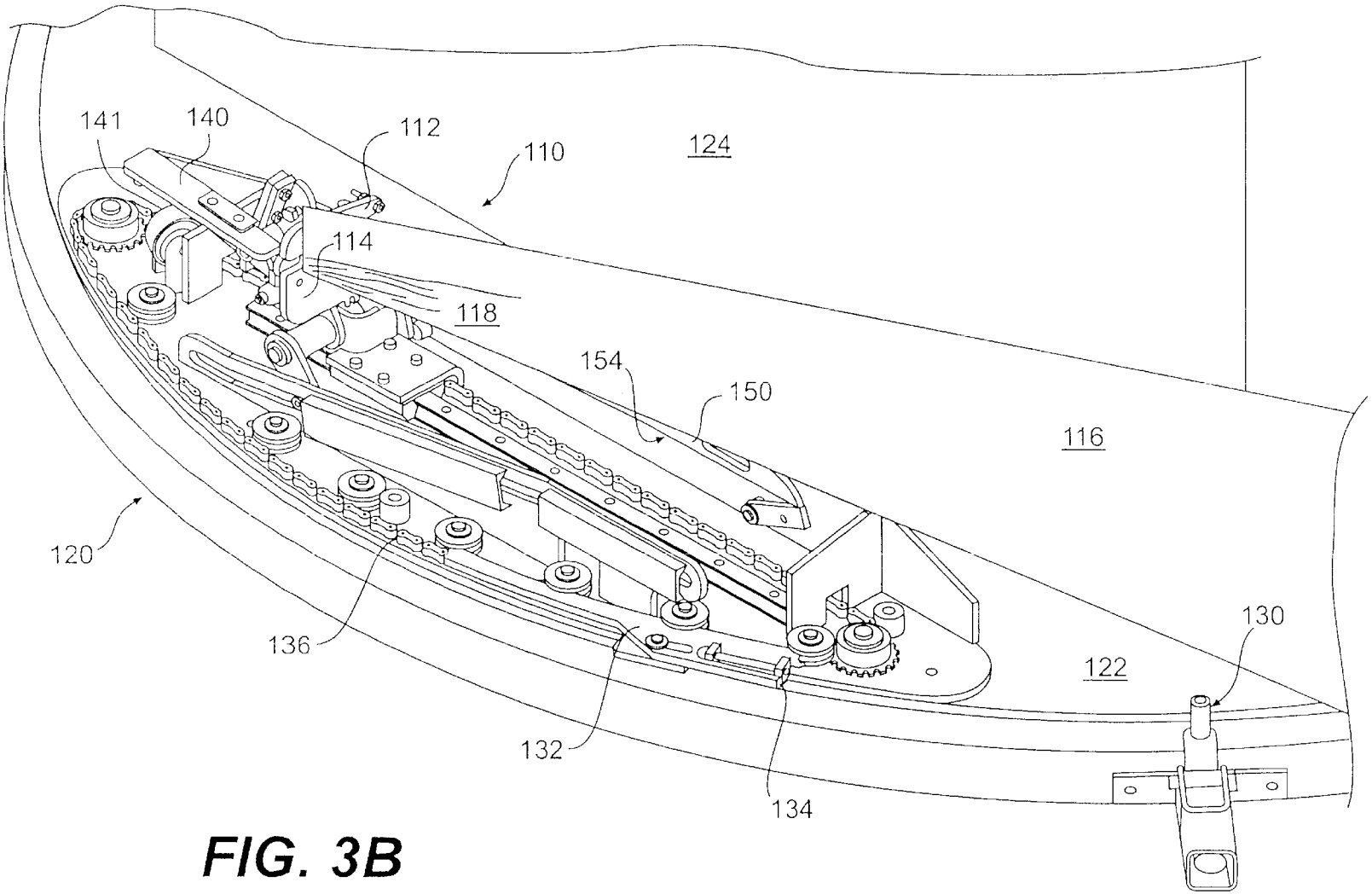
FIG. 3B is a perspective view of the packaging material holder of FIG. 3A mounted on a turntable.
Figure 4A:
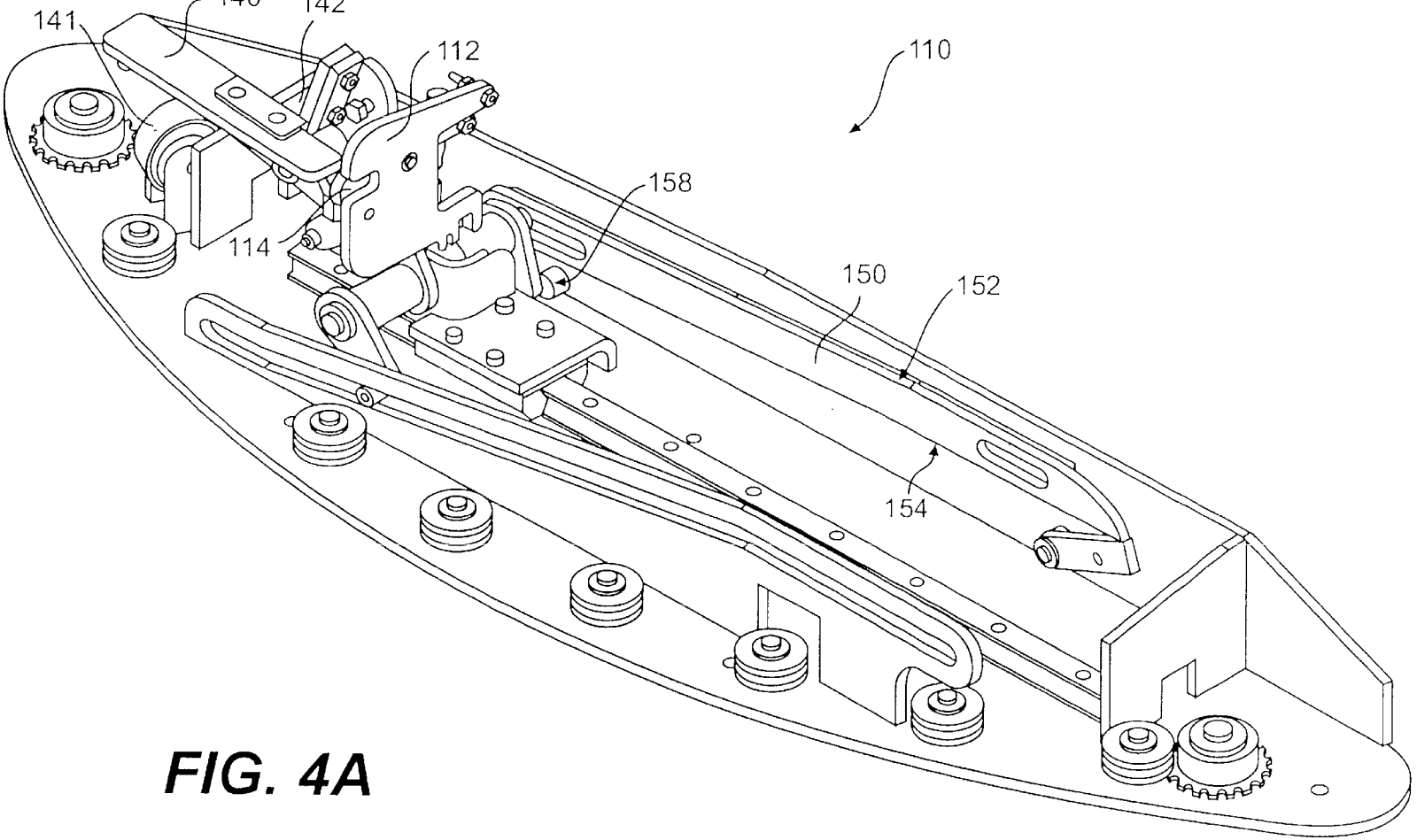
FIG. 4A is a perspective view showing the packaging material holder of FIG. 3 from an opposite side.
Figure 4B:
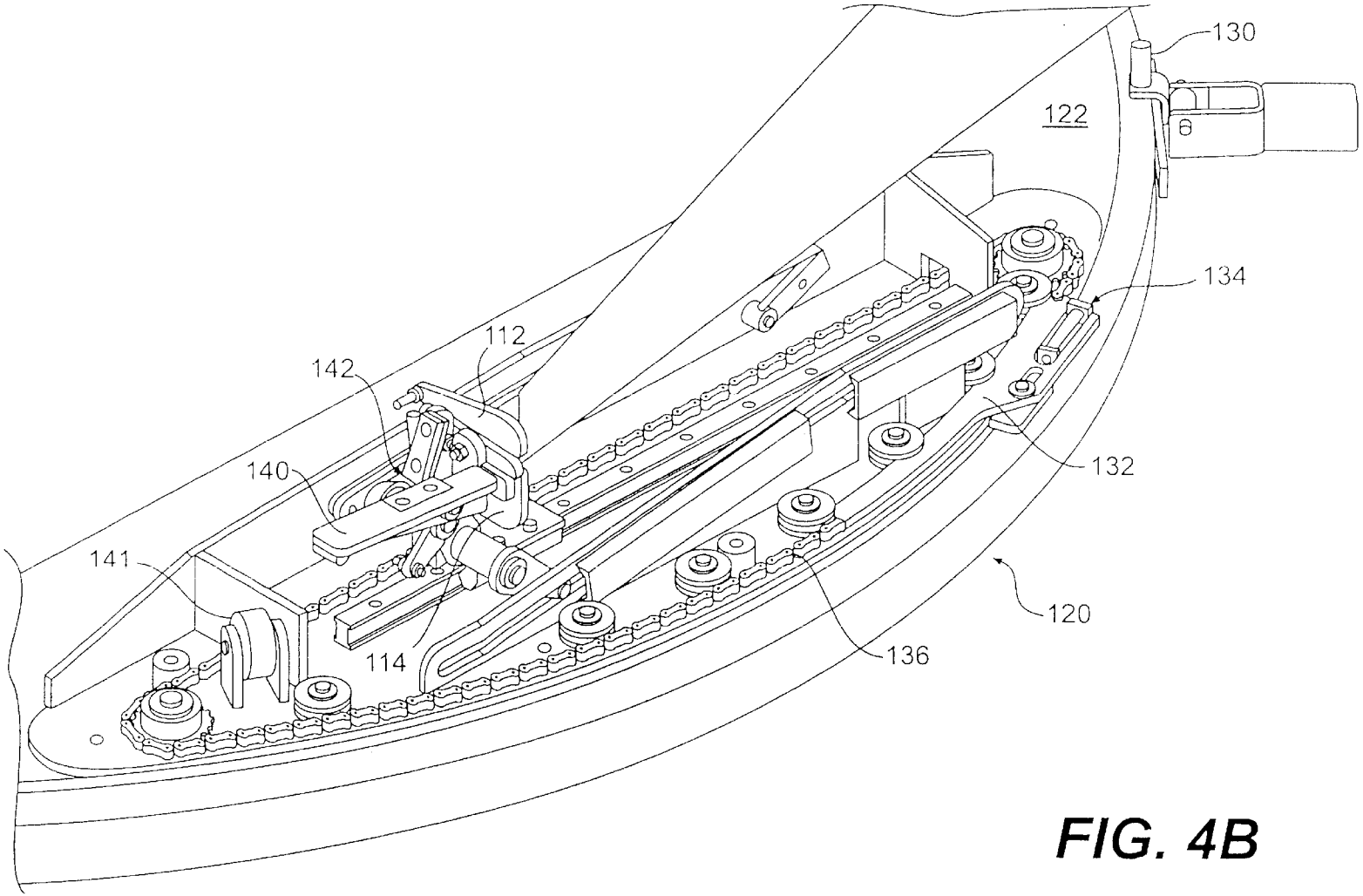
FIG. 4B is a perspective view of the packaging material holder of FIG. 4A mounted on a turntable.

As embodied herein and shown in FIGS. 3A, 3B a packaging material weakener is provided for weakening the packaging material 116 between the load 124 and the dispenser 102. The packaging material holder 110 preferably includes a cutter 142. Cutter 142 may include an opposed cutting element, such as scissors, or a single cutting element such as a razor blade. Cutter 142 is connected to an actuation lever 144 which moves with jaws 112, 114. Actuation lever 144 is moveable between a free position and a contact position. As jaws 112, 114 move along downstream path 152, jaws 112, 114 open, automatically releasing packaging material 116, scooping element 140 moves upward to scoop the lower edge of the web of packaging material 116 into a rope 118, and actuator lever 144 moves from the free position to the contact position. When actuation lever 144 is in the contact position, cutter 142 is activated to weaken packaging material 116 by cutting at least a portion of the web of packaging material 116, including the rope 118 of packaging material 116.

According to one aspect of the present invention, the apparatus may include means for securing a trailing end of packaging material to the load. As embodied herein, the means for securing includes a film wipedown mechanism for wiping a film tail onto the load after the packaging material has been cut. As shown in FIGS. 1A, 1B the film wipedown mechanism 180 includes wipe loops 182 and a wipe arm 184. This allows a film tail to be wiped onto load 124 as the packaging material 116 is cut.

Other cutters and wipedown arrangements may also be used.

A method for wrapping a load according to the present invention is shown in FIGS. 5–11. As shown in FIG. 5 and according to a preferred embodiment of the present invention, a load 124 is conveyed by a conveyor 118 to a turntable assembly 120 in the wrapping station and load 124 is positioned on top of rotatable turntable 122 of turntable assembly 120. Jaws 112, 114 of packaging material holder 110 hold a leading end portion 30 of a roped sheet of packaging material 116, preferably stretch wrap packaging material. Cog 132 is positioned at a downstream end of packaging material holder 110, and jaws 112, 114 are positioned at the upstream end of packaging material holder 110, and cam follower 158 is positioned to the upstream side of ramp 150 (FIG. 5).

Rotatable turntable 122 begins to rotate and packaging material 116 is dispensed from dispenser 102 about load 124. As packaging material 116 passes over packaging material holder 110, wheel 41 engages the lower edge of the packaging material, ensuring that the packaging material passes over packaging material holder 110 and does not become caught on it. This avoids a "tenting" effect and allows tight wrapping of the load. Load 124 is spirally wrapped with packaging material 116 as dispenser 102 moves vertically along mast 104 as the relative rotation is provided.

Figure 6:
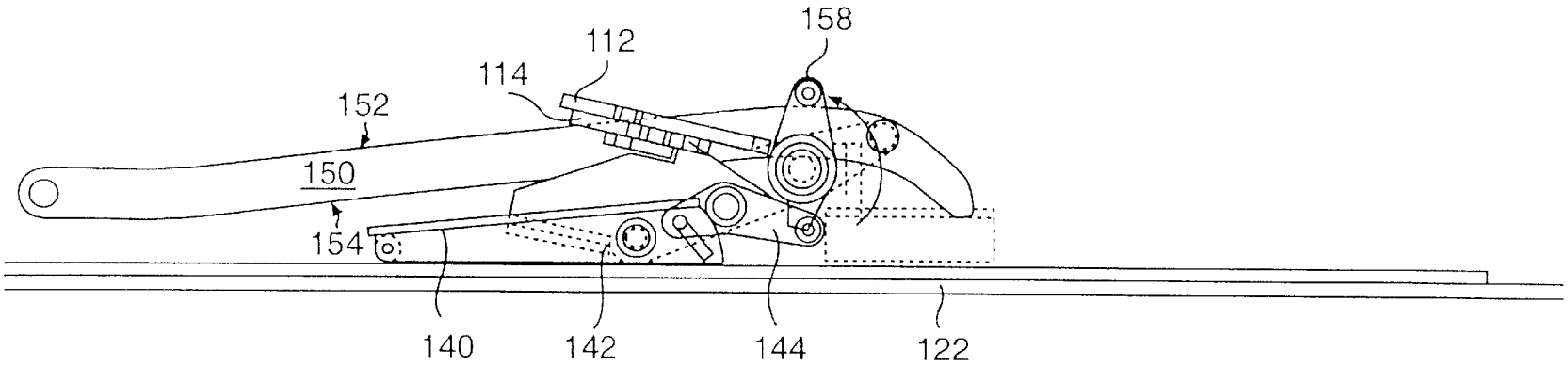
Figure 7:
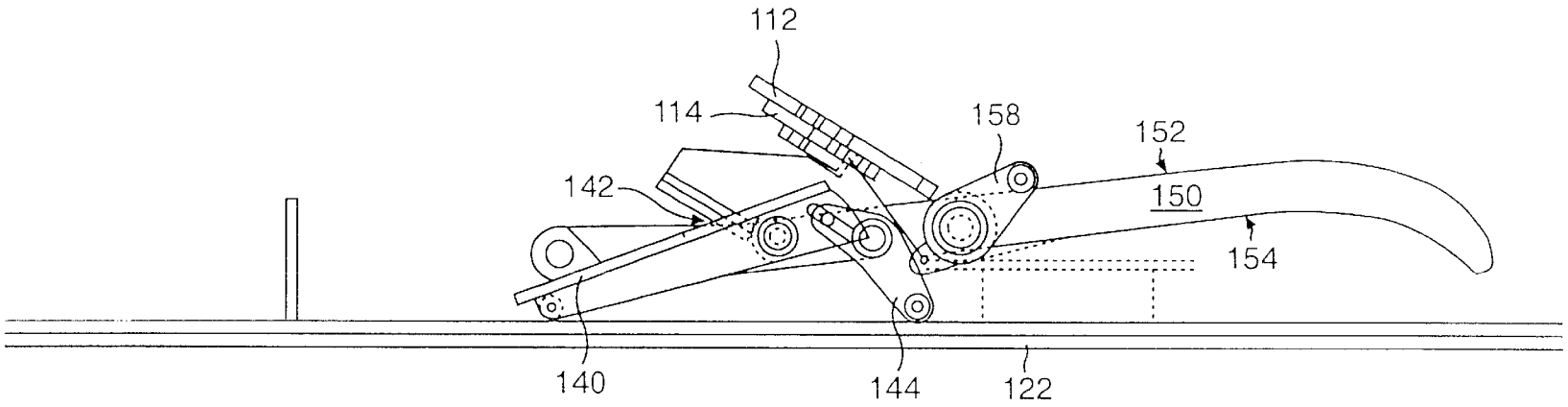
Figure 8:
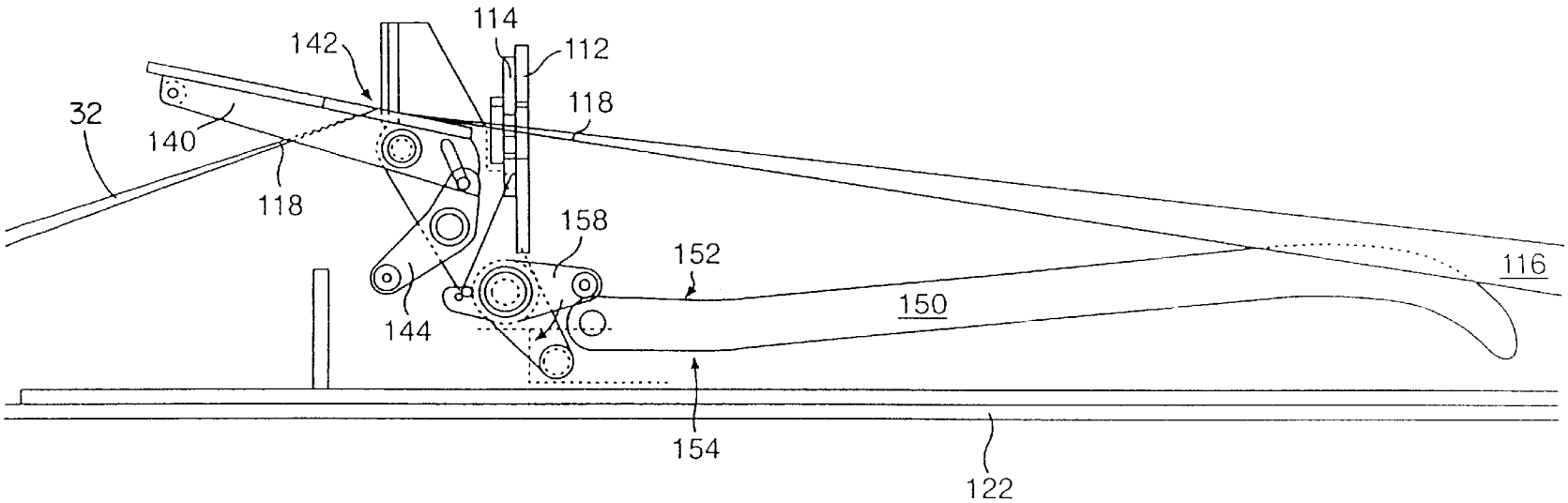
Figure 9:
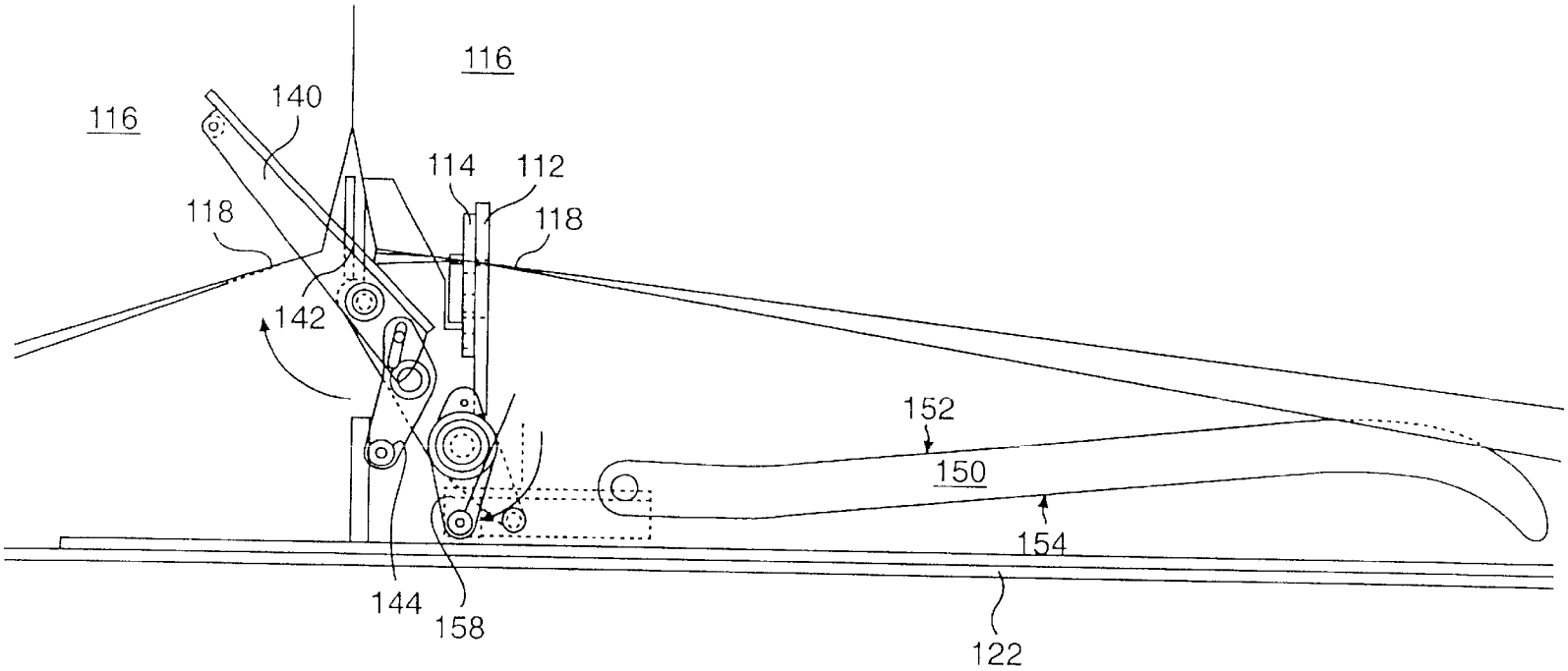
Figure 10:
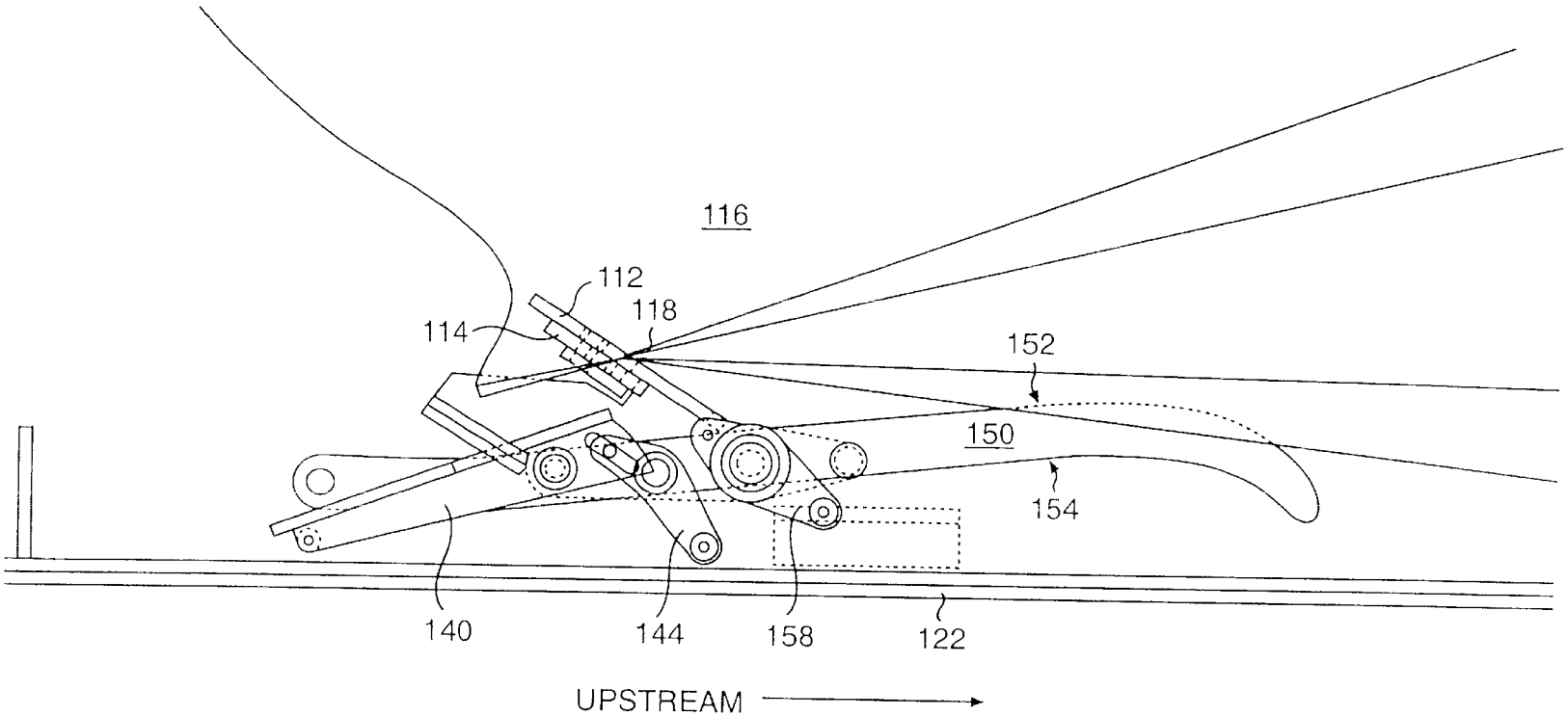
Figure 11:
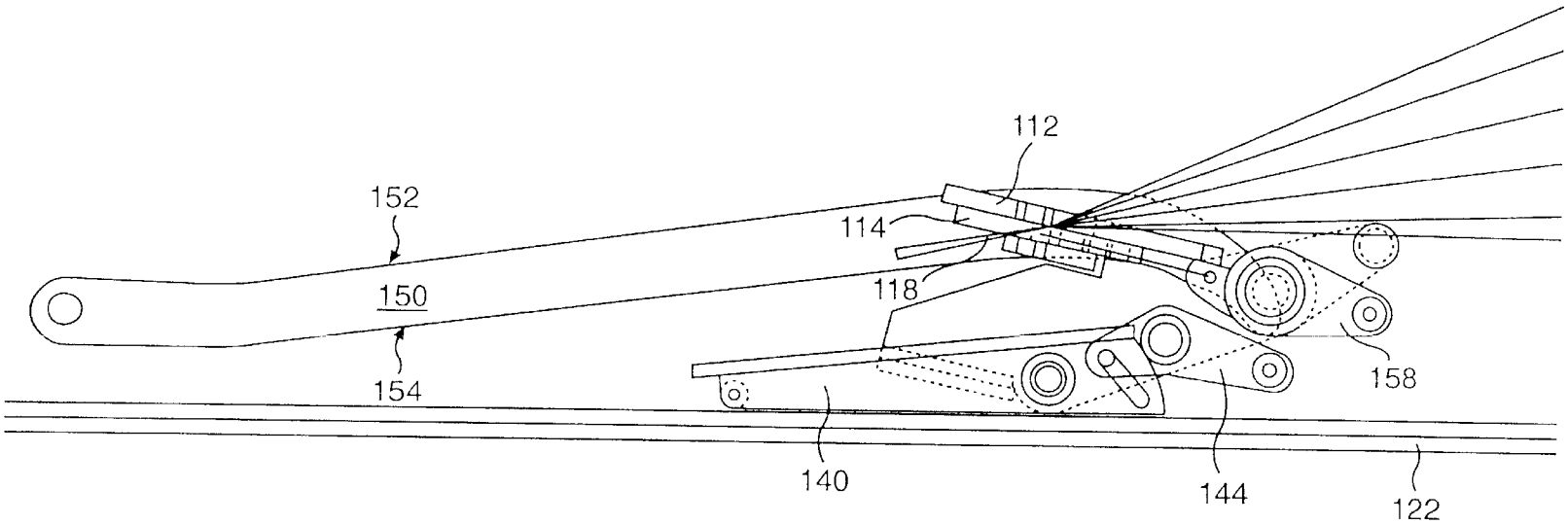

As the load is wrapped and rotatable turntable 122 enters the last rotation of the wrapping cycle, see FIG. 6, a pin 130 attached to a non-rotating portion of turntable assembly 120 is actuated by the controller, moving from a non-upright position to an upright position. As the turntable 122 rotates, pin 130 engages engaging element 134 of cog 132, located on top of rotatable turntable 122 of turntable assembly 120. Pin 130 causes cog 132 to move upstream (in a direction opposite to that of the rotation) along the top surface of rotatable turntable 122 of turntable assembly 120 as rotation continues.

As cog 132 moves, the movement causes cam follower 158 to move up onto the top of ramp 150, to the start of downstream path 152. When cam follower 158 moves to the top of ramp 150, jaws 112, 114 open, automatically releasing leading end portion 30 of packaging material 116 (see FIG. 7). Additionally, dispenser 102 is shut off to tension the film between load 124 and dispenser 102.

As cog 132 moves, it drives jaws 112, 114 downstream along a downstream path 152 of ramp 150. Concurrently, scooping element 140 begins to move from a retracted position to an upright position, scooping a trailing end 32 of packaging material 116 into a rope 118. As jaws 112, 114 continue to move downstream, they remain open, receiving trailing end 32 of packaging material 116 formed into rope 118 as scooping element 140 reaches its full upright position (see FIG. 8). As cog 132 reaches the upstream end of packaging material holder 110, cam follower 158 reaches the end of path 152 and rolls off the end of ramp 150, causing jaws 112, 114 to automatically clamp shut on and grasp trailing end 32 of roped packaging material 116.

As scooping element 140 is moving from the retracted position to the full upright position (see FIG. 9), actuation lever 144 moves from the free position to the contact position, activating cutter 142 to weaken packaging material 116 between jaws 112, 114 and load 124 after jaws 112, 114 have automatically grasped the trailing end 32 of packaging material 116. At the same time, pin 130 encounters release element 138 at the upstream end of packaging material holder 1101 which knocks pin 130 into its nonupright upright position, causing it to disengage from cog 132.

Once jaws 112, 114 have reached the downstream end of packaging material holder 110, they grasp and hold trailing end 32 of packaging material 116. Packaging material 116 extends between dispenser 102, jaws 112, 114, and load 124. The tension in packaging material 116 between dispenser 102 and jaws 112, 114 causes jaws 112, 114 to move upstream toward the dispenser (see FIG. 10). Jaws 112, 114 move upstream as cam follower 158 travels along upstream path 154 of ramp 150 in response to the force exerted by the packaging material. Because cam follower 158 can travel underneath the floating cam (ramp 150) as it returns upstream, instead of traveling on top of ramp 150, jaws 112, 114 remain shut as they travel upstream. As jaws 112, 114 holding trailing end 32 of packaging material 116 move upstream, packaging material 116 is tensioned between jaws 112, 114 and load 124. Because of the relative movement of the packaging material holder, packaging material 116 then breaks at the weakened portion between load 124 and jaws 112, 114, rather than between the packaging material holder and the dispenser. This provides a true automatic operation by maintaining the packaging material to be held in the packaging material holder before, during and after severing.

Other arrangements for permitting the packaging material holder to move upstream with the packaging material toward the dispenser may also be provided.

Although the arrangement illustrated in the drawings weakens and then breaks the packaging material between the load and the jaws, it is in the scope of the one aspect of the invention to weaken the film somewhere between the dispenser and the load, and then break the film between the jaws and the load. Additionally, it is possible to simply sever the packaging material, as opposed to weakening and then breaking the packaging material.

All of the functions can be controlled with a conventional microprocessor, electromechanical controller, or other controller devices which are conventionally used with the stretch wrapping apparatus.

The present invention as embodied herein and described above, allows fully automated wrapping of loads at a drastically reduced cost and in an extremely efficient manner. The simplicity of the apparatus and its function allows existing rotary stretch wrapping apparatus to be retrofit to become fully automated. By using the rotation of the turntable to facilitate the releasing, grasping, and cutting of the packaging material, the need to supply power through the rotatable turntable of the turntable assembly to the packaging material holder and the need for expensive timing circuits is eliminated.

It will be apparent to those skilled in the art that various modifications and variations can be made in the present invention without departing from the spirit or scope of the invention. Thus, it is intended that the present invention cover all modifications and variations of this invention that come within the scope of the appended claims and their equivalents.

What is claimed is:

1. A method of wrapping a load with packaging material, comprising:

grasping a leading end of packaging material with a packaging material holder mounted on a rotatable turntable of a turntable assembly and isolated from any electrical or fluid power source by the rotatable turntable;

dispensing packaging material from a packaging material dispenser and rotating the turntable to wrap packaging material around the sides of the load;

actuating the packaging material holder by rotating the rotatable turntable relative to an actuator;

automatically releasing the leading end of the packaging material from the packaging material holder; and automatically grasping a trailing end of the packaging material with the packaging material holder at a point upstream of the leading end.

2. The method of claim 1, wherein actuating the packaging material holder includes rotating the rotatable turntable relative a non-rotatable portion of the turntable assembly.

3. The method of claim 1, wherein the automatically grasping includes grasping the packaging material with jaws.

4. The method of claim 1, wherein the automatically releasing includes releasing the packaging material from jaws of the packaging material holder.

5. The method of claim 1, further comprising severing the packaging material.

6. The method of claim 5, wherein severing the packaging material occurs subsequent to automatically grasping a trailing end of the packaging material.

7. The method of claim 1, including roping the packaging material.

8. The method of claim 7, wherein roping the packaging material occurs prior to automatically grasping the packaging material.

9. The method of claim 1, including securing the trailing edge of the packaging material to the load after severing the packaging material.

10. The method of claim 1, including roping the packaging material and subsequently severing the roped packaging material.

11. An apparatus for wrapping a load with packaging material, comprising:

a dispenser for dispensing packaging material;

turntable assembly having a rotatable turntable for providing relative rotation between the dispenser and the load to wrap packaging material around the load;

an actuator actuatable by rotation of the rotatable turntable relative to the actuator, wherein the actuator does not rotate with the rotatable turntable; and a packaging material holder mounted on the rotatable turntable and isolated from any electrical or fluid power source by the rotatable turntable for automatically grasping and releasing portions of the packaging material.

12. The apparatus of claim 11, wherein the actuator includes a nonrotatable portion of the turntable assembly.

13. The apparatus of claim 11, wherein the packaging material holder includes jaws for grasping the packaging material.

14. The apparatus of claim 11, including means for securing a trailing end of the packaging material to the load.

15. The apparatus of claim 11, including means for severing the packaging material.

16. The apparatus of claim 11, including means for forming a rope of packaging material.

17. The apparatus of claim 11, further including an opposed cutting element.

* * * * *

UNITED STATES PATENT AND TRADEMARK OFFICE

CERTIFICATE OF CORRECTION

PATENT NO. : 6,449,922 B2
DATED : September 17, 2002
INVENTOR(S) : Lancaster, III et al.

It is certified that error appears in the above-identified patent and that said Letters Patent is hereby corrected as shown below:

Column 10,
Line 3, change “relative” to -- relative to --.
Line 28, change “turntable assembly” to -- a turntable assembly --.

Signed and Sealed this

Twenty-fifth Day of February, 2003

JAMES E. ROGAN
*Director of the United States Patent and Trademark Office*